US011702835B1

(12) United States Patent
Batukan

(10) Patent No.: US 11,702,835 B1
(45) Date of Patent: Jul. 18, 2023

(54) SELF-ALIGNING MODULAR CONNECTOR

(71) Applicant: Mehmet Baris Batukan, Toronto (CA)

(72) Inventor: Mehmet Baris Batukan, Toronto (CA)

( * ) Notice: Subject to any disclaimer, the term of this patent is extended or adjusted under 35 U.S.C. 154(b) by 0 days.

(21) Appl. No.: 17/648,164

(22) Filed: Jan. 17, 2022

(51) Int. Cl.
*E04B 1/343* (2006.01)
*E04H 1/00* (2006.01)

(52) U.S. Cl.
CPC ..... *E04B 1/34384* (2013.01); *E04H 1/005* (2013.01)

(58) Field of Classification Search
CPC ..... E04B 1/34384; E04H 1/005
See application file for complete search history.

(56) References Cited

U.S. PATENT DOCUMENTS 1,515,257 A * 11/1924 Krasnow ..... E04C 3/30 52/301
4,435,927 A * 3/1984 Umezu ..... E04B 1/3483 52/235
5,678,375 A * 10/1997 Juola ..... E04B 1/24 52/236.7
8,607,515 B2 * 12/2013 Jarvis ..... E04B 1/0038 403/258
8,800,232 B1 * 8/2014 Keenan ..... E04B 1/41 52/125.4
9,366,020 B2 * 6/2016 Farnsworth ..... E04H 1/04
9,458,619 B2 * 10/2016 Bowron ..... E04B 1/2403
9,845,595 B2 * 12/2017 Bowron ..... F16S 3/04
10,822,789 B1 * 11/2020 Mou ..... E04C 3/36
10,870,980 B2 * 12/2020 Bowron ..... E04B 1/2403
10,947,716 B2 * 3/2021 Bowron ..... F16B 7/185
2011/0243644 A1 * 10/2011 Jarvis ..... E04B 1/4128 403/25
2014/0123573 A1 * 5/2014 Farnsworth ..... E04B 1/3483 52/79.9
2016/0002909 A1 * 1/2016 Bowron ..... F16B 7/0486 52/745.03
2017/0044753 A1 * 2/2017 Bowron ..... E04B 1/1903
2019/0330838 A1 * 10/2019 Bowron ..... E04B 1/3483
2020/0048890 A1 * 2/2020 Bowron ..... E04H 1/005
2021/0277649 A1 * 9/2021 Bowron ..... E04B 1/5825

* cited by examiner

*Primary Examiner* — Rodney Mintz

(57) ABSTRACT

A modular connector is disclosed that comprises of a middle-plate, a plurality of sectioned-base-plates, and a plurality of locking-plates. The middle-plate and the plurality of sectioned-base-plates have a plurality of slotted holes to enable faster construction and deal with construction tolerances efficiently. Also, a plurality of grooved surfaces on the sectioned-base-plate and the locking-plate provide a system so that bolted-connected modules do not slide and remain at initially its aligned position. Disclosed is also a method for assembling a modular building.

14 Claims, 8 Drawing Sheets

SELF-ALIGNING MODULAR CONNECTOR

FIELD OF THE INVENTION

The invention relates to conventional and modular buildings, a system for connecting a plurality of columns of a building to form a multi-story structure, a method of assembling a building with a connection assembly, a system for assembling a modular building, a method of assembling a modular building with a connection assembly.

BACKGROUND OF THE INVENTION

Modular construction is an alternative to traditional construction, and is basically a combination of off-site and on-site construction to form typical multi-story buildings. Over the years, it has been used in a variety of different building types such as hospitals, schools, hotels, etc. One of the advantages of modular construction is used to enable faster construction with taking advantage of off-site production of modules ahead of on-site construction schedule. Therefore, it is a remedy for immediate accommodation needs such as hospitals during a pandemic.

Modular buildings differ from traditional ones since a modular building possesses a plurality of floor and ceiling beams (rather than a single beam per story), a plurality of separate diaphragms (rather than continuous diaphragms), and a plurality of horizontal and vertical connections between modules (rather than continuous structural member along the height of the structure). The latter is one of the main challenges of modular construction due to construction tolerances. Construction tolerance is a part of the design and construction process, and designers and manufacturers should give attention to construction tolerances to prevent delays and facilitate construction. There are three types of construction tolerances, namely mill, fabrication, and field tolerances. Mill tolerances occur during the production of plain members, whereas fabrication tolerances result from production of structural members such as trusses and beam. Moreover, field tolerances are a result of site preparation (location of foundation, piers, building lines, abutments, etc.) and erection tolerances. In short, tolerances can easily be observed in any construction phase, and they should be taken into account carefully. Otherwise delays in the construction schedule and unexpected costs associated with repairs and fixes are inevitable.

A plurality of modules of a volumetric box-shaped modular building can be produced at a controlled environment (off-site), and is somewhat advantageous for fabrication tolerances which can be reduced remarkably. Field tolerances, however, is still a well-known issue and prevent modular construction from growing faster globally.

As mentioned previously, connections are a significant part of modular buildings, and there have been several attempts to connect modules of multi-story modular buildings. For instance, some recently disclosed connections for modular building can be given in U.S. Pat. No. 9,366,020 to Farnsworth and U.S. Pat. No. 10,947,716 to Bowron. Farnsworth's connection is comprised of several parts. Horizontal connectivity relies on a middle plate, and vertical connectivity is provided with tension rods; however, construction tolerances have not been addressed in detail. Moreover, it is possible to observe that construction tolerances in Bowron's connection was not even taken into account and requires high-precision production, and is very likely to encounter connectivity issues if structural members have an inherent imperfection out of fabrication facility.

The present invention is aimed to deal with construction tolerances and facilitate assembly processes to enable faster connection for mainly but not limited to modular construction. The invention can also be used to connect modules to an additional lateral load resisting system (e.g., structural wall) to resist lateral loads such as high intensity ground motions and cyclonic wind loads.

SUMMARY OF THE INVENTION

The present invention, self-aligning modular connector, aims to provide faster joint connection for a plurality of main-columns of a multi-story modular building. Structural shape of the main-column is illustrated as a hollow steel section which is most commonly used in a modular building, but it can be any other shape depending on design requirements.

The plurality of main-columns of a modular building are connected to provide continuous load paths both horizontally and vertically. However, it is very likely to experience misalignment during the assembly process due to construction tolerances. Consequently, groups of bolt holes may become misaligned with the bolt holes beneath or in an adjacent module, and extra effort would need to be made to connect the plurality of the main-columns. For this reason, the present invention enables the movement on the horizontal plane (orthogonal to vertical axis) to facilitate the connection between the plurality of the main-columns.

According to the invention, a sectioned-base-plate having a top-grooved-surface, a bottom-grooved-surface, and a plurality of base-plate-slotted-holes in one direction only are attached to each end of the plurality of main-columns, and the sectioned-base-plate can also be attached to a short-column prior to attaching them to each main-column. Once the plurality of main-columns have each the sectioned-base-plate attached (the plurality of base-plate-slotted-holes of lower and upper modules should be orthogonal to each other), a middle-plate with a plurality of middle-plate-slotted-holes can be placed between the plurality of sectioned-base-plates like a sandwich. A plurality of locking-plates with a bottom-locking-grooved-surface, a top-locking-flat-surface, and a plurality of locking-plate-holes can be positioned onto a plurality of top- and bottom-base-plates to prevent slipping between the plurality of top- and bottom-base-plates and the middle-plate. A bolt can then be inserted into each middle-plate-slotted-hole, each base-plate-slotted-hole, and each locking-plate-hole. Lastly, each bolt can be tightened with a bolt nut to complete the assembly.

BRIEF DESCRIPTION OF THE DRAWINGS

In the drawings, the reference numbers refer to the same parts of the present invention in the different views. Additionally, the drawings are not necessarily to scale.

DETAILED DESCRIPTION OF THE INVENTION

The embodiments herein and the various features and advantageous details thereof are explained more fully with reference to the non-limiting embodiments that are depicted in the accompanying drawings and detailed in the following description. Descriptions of well-known components and processing techniques are omitted in order to not unnecessarily obscure the embodiments herein. The examples used herein are merely intended to facilitate an understanding of ways in which the embodiments herein are practiced and to further enable those of skill in the art to practice the invention.

All materials are preferably made of steel, but any material complying with structural safety and performance requirements of a building can be used.

Figure 1:
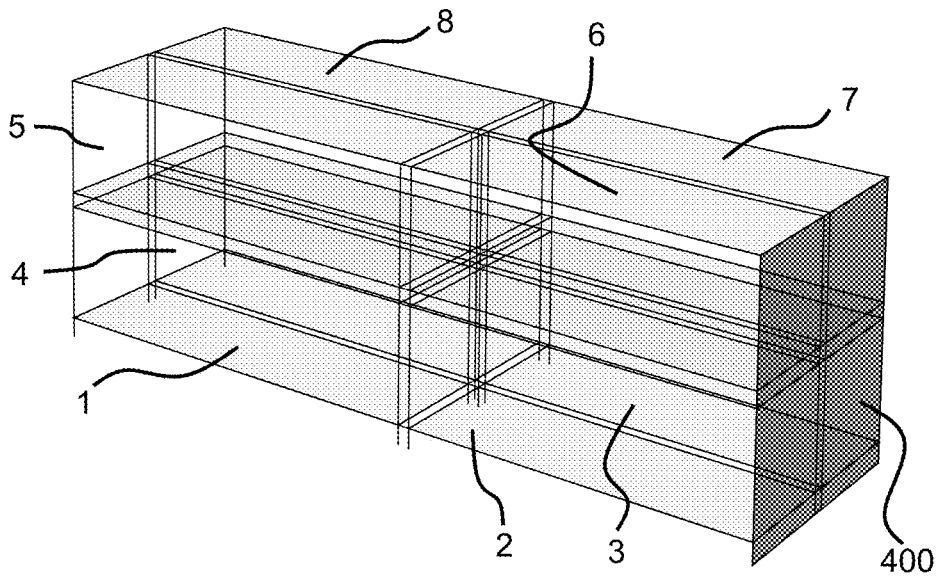
FIG. 1 is 3D view of a two-story modular building section with a side wall.
Figure 2:
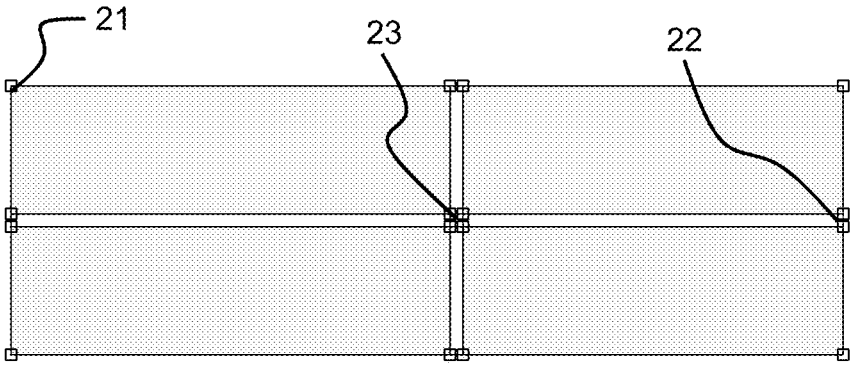
FIG. 2 is a plan view at the first story ceiling level of four modules illustrating three different module connections.

Referring to FIG. 1, centerline of a plurality of structural members (the plurality of beams 102, the plurality of main-columns 101, and the wall 400) of the two-story modular building is shown in 3D section view comprised of four rectangular-box-shaped modules 1, 2, 3, 4 and 5, 6, 7, 8 in the first and second story level, respectively. Top view of centerline of the plurality of structural members at the first story of the modular building is illustrated in FIG. 2. The figure comprised of ceilings level of four modules 1, 2, 3, 4, and a plurality of inter-modular connections, which are a two-module-connection 21 (connecting two 4, 8 modules at their corners), a four-module-connection 22 (connecting four 2, 3, 6, 7 modules at their corners and make a connection to the wall 400), and an eight-module-connection 23 (connecting eight 1, 2, 3, 4, 5, 6, 7, 8 modules at their corners). Though the invention is explained and illustrated on a modular building section (see FIG. 1), it can equally be implemented and used in any building type regardless of being modular. Additionally, it can be implemented and used in any multi-story building having a plurality of multiple closely-spaced columns.

Figure 3:
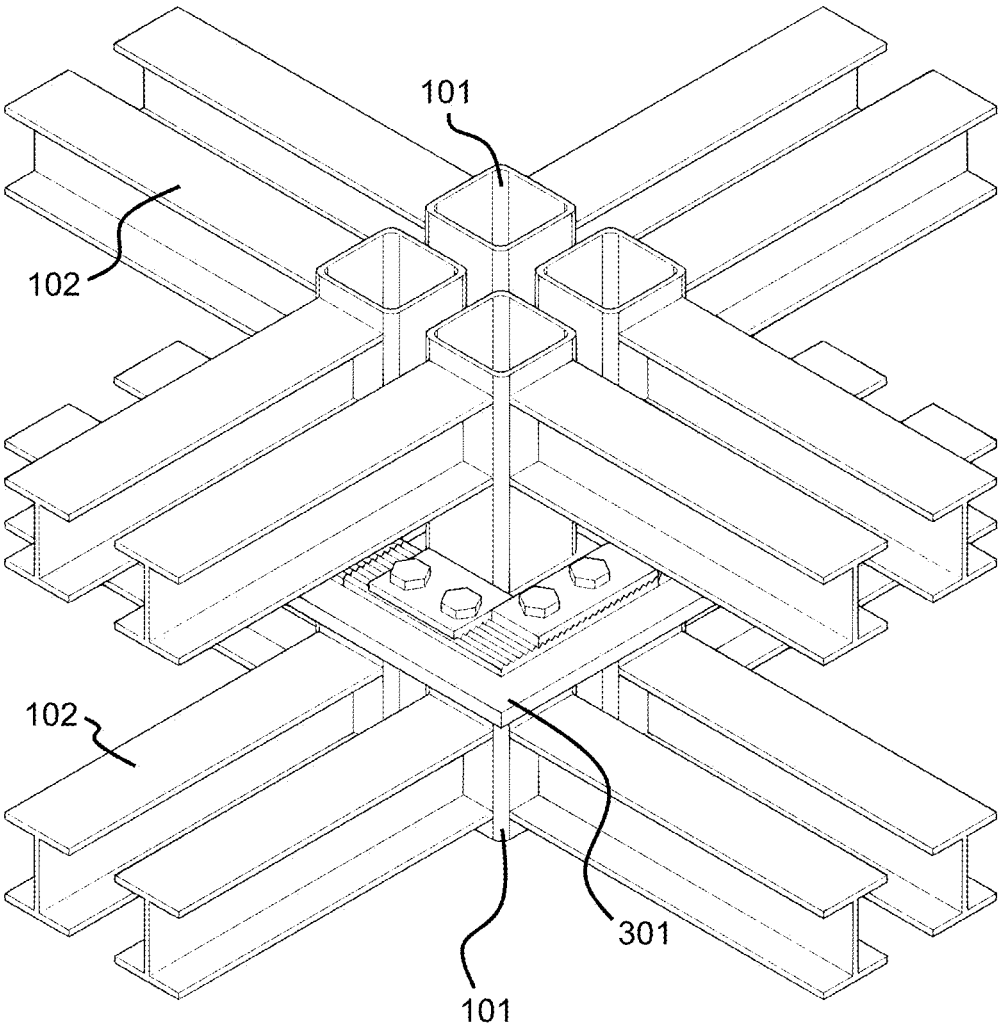
FIG. 3 is 3D view of the present invention showing completed assembly with eight modules connected at one of their common corners and structural members such as the plurality of main-columns, and a plurality of beams.

Referring to FIG. 3, close-up 3D view of the eight-module-connection 23 (shown in FIG. 2) connecting eight modules at their corners is comprised of eight square hollow section main-columns 101, 16 Wide-flange (W-section) ceiling and floor beams 102, the rectangular middle-plate 301.

Figure 4:
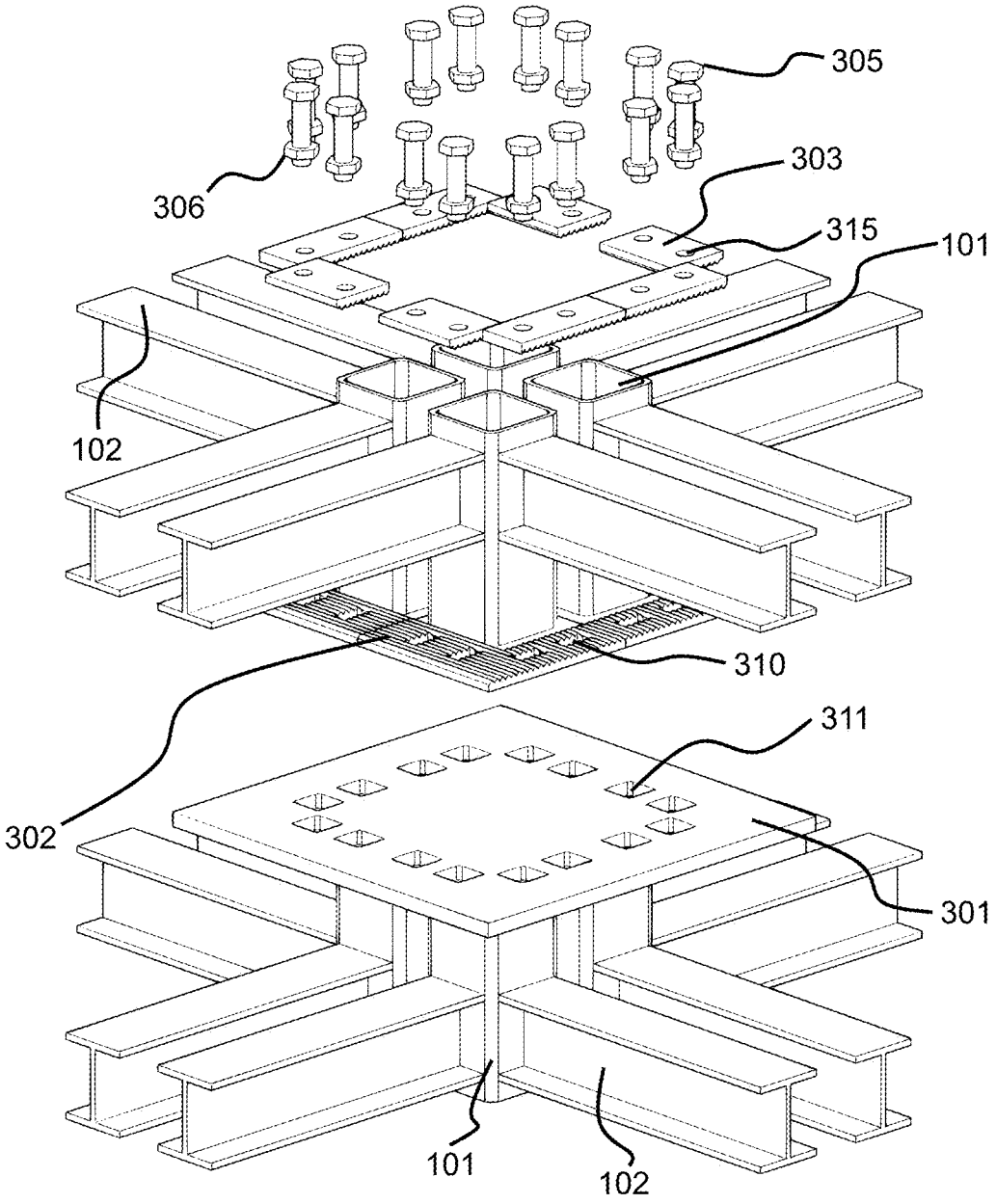
FIG. 4 is 3D view of the present invention showing different parts of the assembly and an assembly procedure.

Referring to FIG. 4, close-up 3D view of the eight-module-connection 23 (shown in FIG. 2) connecting eight modules at their corners is comprised of eight square hollow section main-columns 101, 16 W-section ceiling and floor beams 102, the rectangular middle-plate 301, four rectangular top-base-plates with a top-grooved-surface 302, eight rectangular locking-plates 303 having a bottom-locking-grooved-surface, a top-locking-flat-surface, and having a plurality of locking-plate-holes 315, and 16 bolts 305 with a length longer than combination of thickness of the middle-plate 301, the top-base-plate 302, the bottom-base-plate 302, two locking-plates 303, and the bolt nut 306 which all will be explained in the following paragraph.

Figure 5:
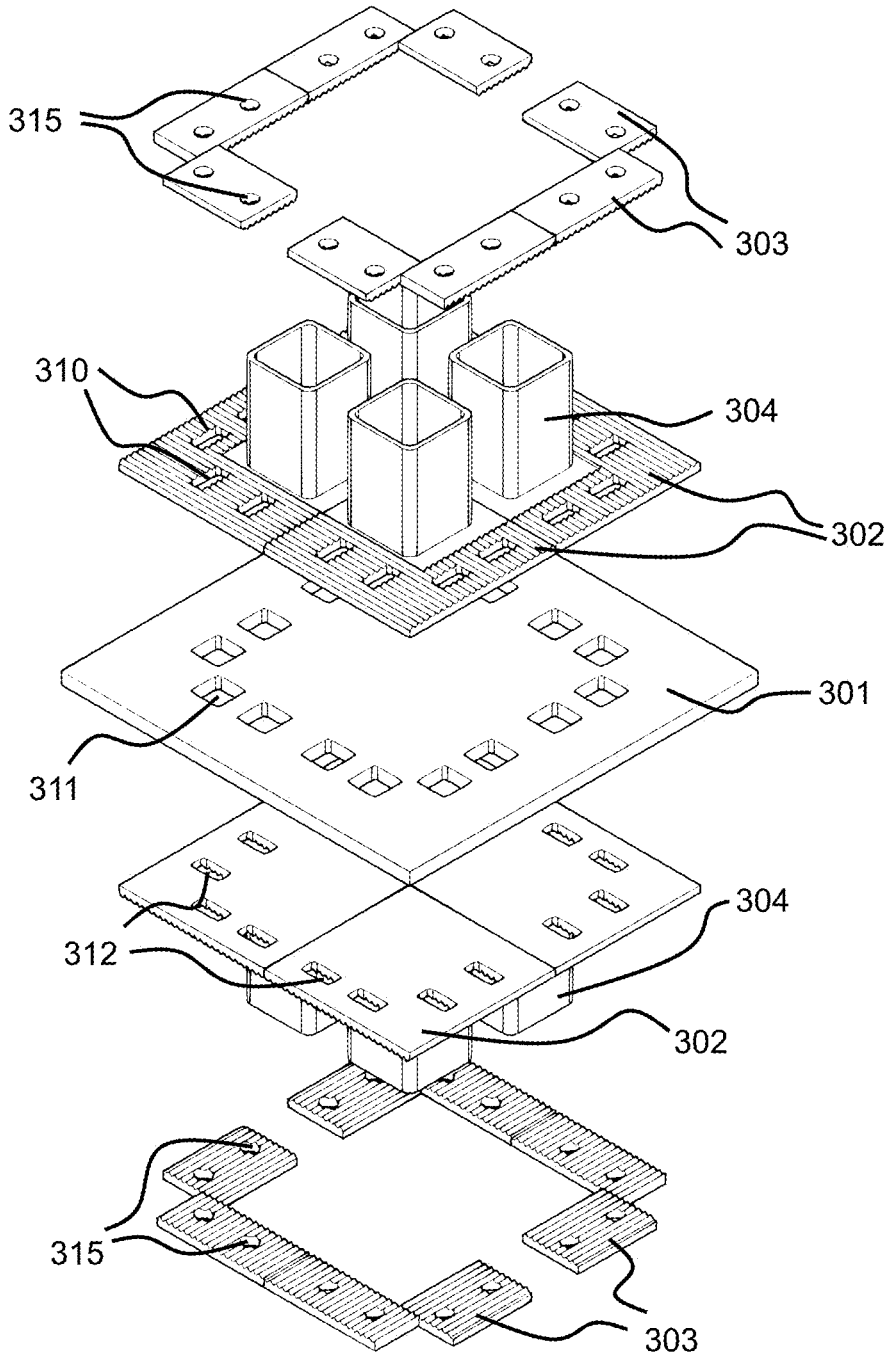
FIG. 5 is 3D view of the parts of the present invention (structural members were removed for clarity).
Figure 9:
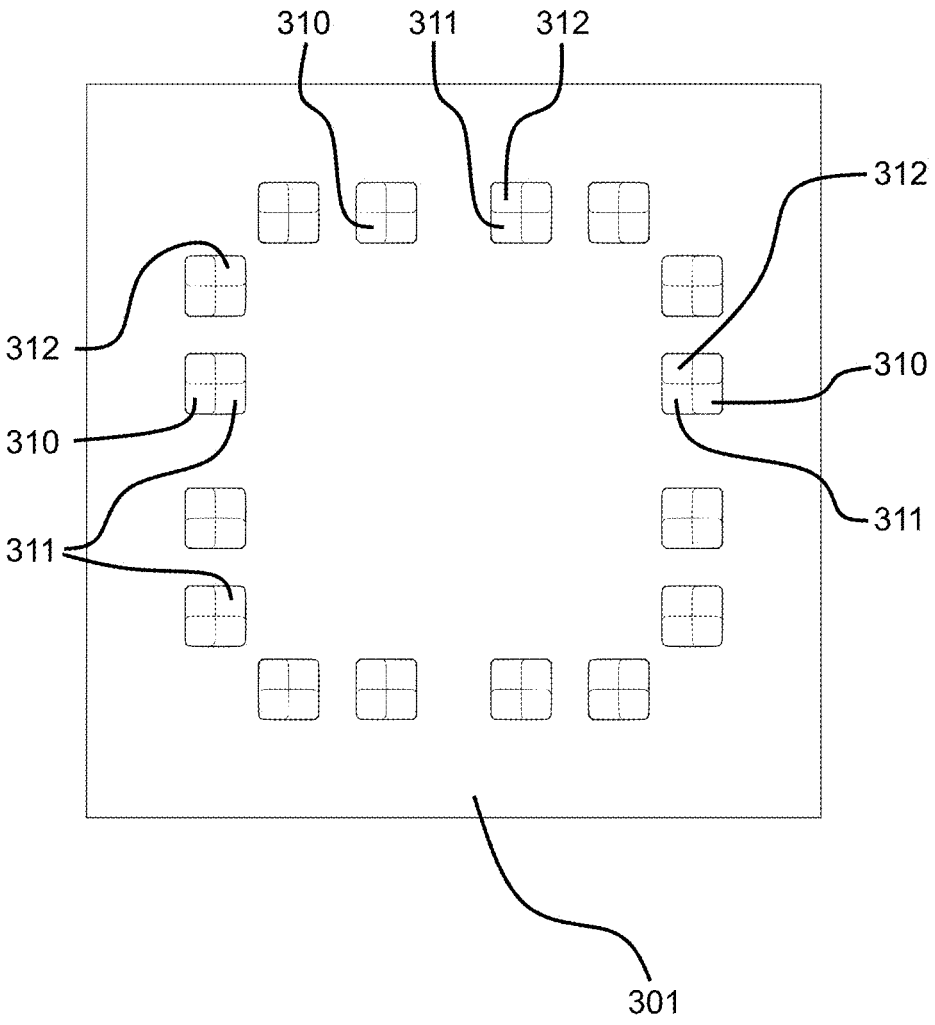
FIG. 9 is a top view of the middle-plate.

Referring to FIG. 5, close-up 3D view of the eight-module-connection connection 23 is illustrated without structural members (the plurality of beams 102 and columns 101) for the sake of clearly showing a plurality of parts of the present invention. The FIG. 5 is comprised of the rectangular middle-plate 301 having the plurality of middle-plate-slotted-holes 311, eight sectioned-base-plates 302 (four top-base-plates and four bottom-base-plates wherein the top-base-plate and the bottom-base-plate are comprised of the plurality of sectioned-base-plates 302 having a top-grooved-surface, a bottom-flat-surface, and the plurality of base-plate-slotted-holes 310, 312, 16 rectangular locking-plates 303 having a bottom-locking-grooved-surface and a top-locking-flat-surface and having a plurality of locking-plate-holes 315, and eight short-columns 304 wherein each short-column is configured to fit inside the main-column 101 of the structure. There are three different slotted holes (middle-plate 311 and base-plate-slotted-hole 310, 312) in the FIG. 5. Width and length of the middle-plate-slotted-hole 311 are preferably equal or greater than length of the base-plate-slotted-hole 310, 312 to enable movement of the middle-plate on the horizontal plate for alignment purposes. Size of the middle-plate-slotted-hole 311 can be best seen from FIG. 9 wherein a top view of the middle-plate is depicted with the plurality of middle-plate-slotted-holes 311, the plurality of base-plate-slotted-holes 310, 312. Length of the base-plate-slotted-holes 310, 312 is preferably long enough to accommodate the construction tolerances and comply with design requirements. Width of the base-plate-slotted-hole 310, 312 is preferably the same as regular bolt holes in the design guidelines (a typical bolt diameter+1/16 inches). Diameter of the locking-plate-hole 315 is preferably the same as regular bolt holes in the design guidelines (a typical bolt diameter+1/16 inches). The plurality of base-plate-slotted-holes in the top-base-plate and the bottom-base-plate (310 and 312, respectively) are orthogonal to each other so that each top-base-plate and each bottom-base-plate can move in one direction only. Each top-base-plate 302, each bottom-base-plate 302 and each locking-plate 303 have a plurality of triangular grooved surfaces (the top-grooved-surface and the bottom-grooved-locking-surface) to prevent slipping in the slotted hole direction. Shape of the top-grooved-surface, the bottom-grooved-locking-surface, the sectioned-base-plate 302, the locking-plate 303 and the middle plate 301, thickness of the middle-plate 301, the-sectioned-base-plate 302, and the locking-plate 303, and the location and the length of the base-plate-slotted-hole 310, 312 and the middle-plate-slotted-hole 311 can be determined and adjusted in accordance with design requirements and expected construction tolerances.

Figure 6:
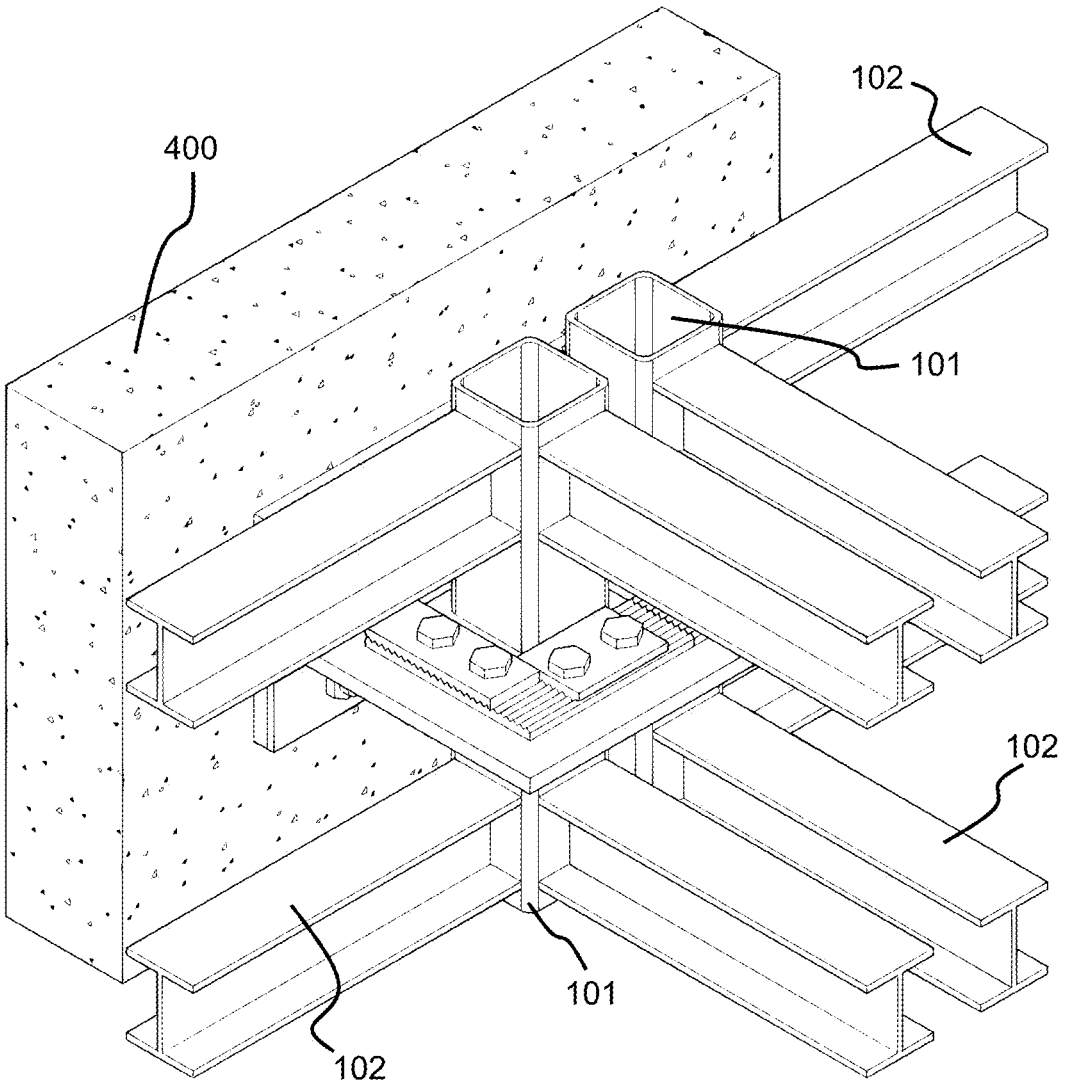
FIG. 6 is 3D view of another embodiment of the present invention showing completed assembly with four modules connected at their common corners to the wall and structural members such as the plurality of main-columns, and the plurality of beams.

Referring to FIG. 6, close-up 3D view of four-module-connection 22 (shown in FIG. 2) connecting four modules together at their corners and to the structural wall 400 is comprised of four-square hollow section main-columns 101, eight W-section ceiling and floor beams 102.

Figure 7:
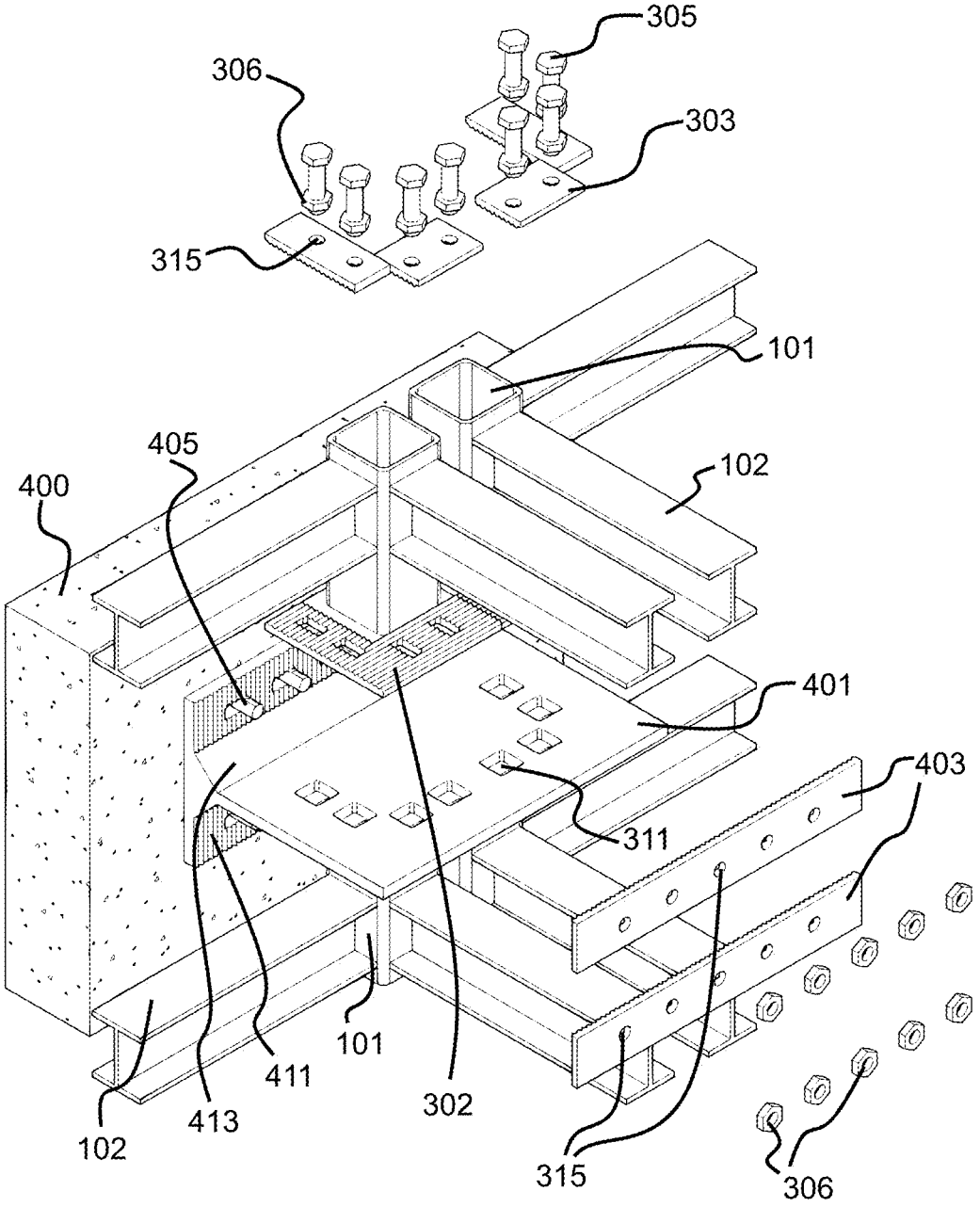
FIG. 7 is 3D view of another embodiment of the present invention showing different parts of the assembly and an assembly procedure.

Referring to FIG. 7, close-up 3D view of the four-module-connection 22 (shown in FIG. 2) connecting four modules together at their corners and to the structural wall 400 is comprised of four square hollow section main-columns 101, eight W-section ceiling and floor beams 102, a rectangular middle plate 401 having a vertical-extension 411 and a fillet section 413, two rectangular top-base-plates with a top-grooved-surface 302, six rectangular locking-plates 303, 403 having a bottom-locking-grooved-surface, the top-locking-flat-surface, and having the plurality of locking-plate-holes 315, 10 anchor-bolts 405 embedded into the wall 400, and eight bolts 305 with a length longer than combination of thickness of the middle-plate 401, the top-base-plate 302, the bottom-base-plate 302, and two locking-plates 303, and the bolt nut 306 which all will be explained in the following paragraph.

Figure 8:
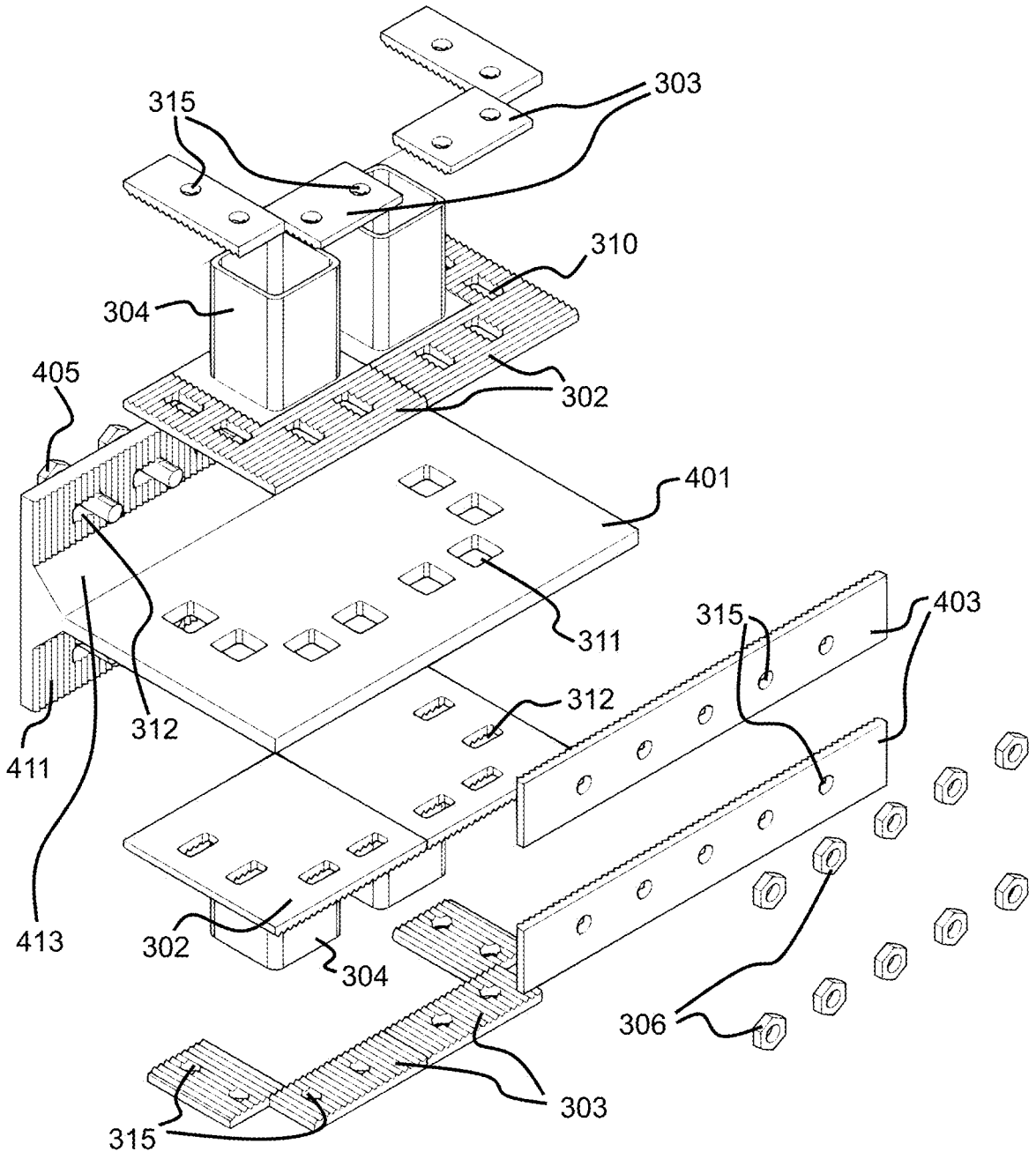
FIG. 8 is 3D view of the parts of another embodiment of the present invention (structural members were removed for clarity).

Referring to FIG. 8, close-up 3D view of the four-module-connection 23 is depicted without structural members (the plurality of beams 102 and the plurality of columns 101) for the sake of clearly showing the plurality of parts of the present invention. The figure comprised of the rectangular middle plate 401 having the vertical-extension 411 and the fillet section 413, four sectioned-base-plates 302 (two top- and two bottom-base-plates) having the top-grooved-surface, the bottom-flat-surface, and the plurality of base-plate-slotted-holes, 10 rectangular locking-plates 303, 403 having the bottom-locking-grooved-surface, the top-locking-flat-surface, and the plurality of locking-plate-holes 315, four short-columns 304 wherein each short-column 304 is configured to fit inside the main-column 101, 10 anchor-bolts 405 embedded into the wall 400, and 10 bolt-nuts 306. The vertical-extension 411 having the vertical-grooved-surface (preferably triangular shapes) and having a plurality of vertical-base-plate-slotted-holes 312 is attached to the middle-plate 401 preferably by welding, and the fillet-section 413 is attached to the middle-plate 401 and the vertical-extension 411 preferably by welding. There are three different slotted holes (middle-plate 311, base-plate-slotted-hole 310, 312, and vertical-base-plate-slotted-hole 312) in the FIG. 8. Width and length of the middle-plate-slotted-hole 311 are preferably equal or greater than length of the base-plate-slotted-hole 310, 312 to enable movement of the middle-plate on the horizontal plate for alignment purposes. Size of the middle-plate-slotted-hole 311 can be best seen from FIG. 9 wherein a top view of the middle-plate is depicted with the plurality of middle-plate-slotted-holes 311, the plurality of base-plate-slotted-holes 310, 312. Length of the base-plate-slotted-holes 310, 312 is long enough to accommodate the construction tolerances and comply with design requirements. Width of the base-plate-slotted-hole 310, 312 is preferably the same as regular bolt holes in the design guidelines (a typical bolt diameter+1/16 inches). Diameter of the locking-plate-hole 315 is preferably the same as regular bolt holes in the design guidelines (a typical bolt diameter+1/16 inches). The plurality of base-plate-slotted-holes in the top-base-plate and the bottom-base-plate (310 and 312, respectively) are orthogonal to each other so that each top-base-plate and each bottom-base-plate can move in one direction only. Each top- and bottom-base-plate 302 and each locking-plate 310 have the plurality of triangular grooved surfaces (the top-grooved-surface and the bottom-grooved-locking-surface) to prevent slipping in the slotted hole direction. Shape of the top-grooved-surface, the bottom-grooved-locking-surface, the sectioned-base-plate 302, the locking-plate 303, the middle plate 401, the fillet-section 413, and the vertical-extension 411, thickness of the middle-plate 401, the sectioned-base-plate 302, and the locking-plate 303, and the location and the length of the base-plate-slotted-hole 310, 312 the middle-plate-slotted-hole 311 can be determined and adjusted in accordance with design requirements and expected construction tolerances.

Assembly method of the present invention for eight-module-connection 23 follows: The plurality of sectioned-base-plates (with or without the short-column) are attached to each end of the plurality of main-columns preferably by welding. A module, for example, should have the plurality of top-base-plate attached to the lower end of each main-column and a plurality of bottom-base-plate attached to the upper end of each main-column. Moreover, direction of the base-plate-slotted-hole in the top- and bottom-base-plate (310 and 312, respectively) should be orthogonal to each other so that alignment can be done in both directions (e.g., X- and Y-directions), and it has to be the same for all modules in the structure. Besides, since a plurality of lower modules 1, 2, 3, 4 are already in place, they hardly provide movement for the alignment purposes; therefore, the middle-plate 301 can be aligned in the perpendicular direction to the plurality of top-base-plates 302. Once a plurality of lower modules (e.g., 1, 2, 3, 4) are placed and connected to foundation, the middle-plate 301 is placed to top of the plurality of bottom-base-plates 302. This phase of the assembly is illustrated in FIG. 4 in 3D. Then, a plurality of upper modules (e.g., 5, 6, 7, 8) are placed to a planned location accordingly. Once the plurality of base-plate-slotted-holes 310, 312 and the plurality of middle-plate-slotted-holes 311 are aligned, and a bolt 305 can go thorough each slotted hole, the plurality of locking-plates 303 should be placed onto top of each sectioned-base-plate 302 with respect to matching pattern on the top-grooved-surface. Then, each bolt 305 can preferably be tightened from the lower modules 1, 2, 3, 4 with a bolt nut 306 to complete the assembly. Additionally, completed assembly is shown in FIG. 3 in 3D.

Assembly method of the present invention for four-module-connection 22 follows: In addition to the above method, a plurality of anchor bolts should be embedded into the wall 400 prior to starting the assembly. This phase of the assembly is illustrated in FIG. 7 in 3D. Then, the middle-plate 401 can also be aligned and connected to the wall 400. The plurality of locking-plates 303 should be positioned onto the vertical-extension 411 having the vertical-grooved-surface. Lastly, each anchor-bolt 405 can preferably be tightened from the lower 1, 2, 3, 4 and upper 5, 6, 7, 8 modules and with a bolt nut 306 to complete the assembly. Additionally, completed assembly is shown in FIG. 6 in 3D.

What is claimed is:

1. A modular connector, consisting of:

a) a middle-plate having a plurality of middle-plate-slotted-holes;

b) a top-base-plate attached to a top of the middle-plate and a bottom-base-plate attached to a bottom of the middle-plate, wherein the top-base-plate and the bottom-base-plate are composed of a plurality of sectioned-base-plates having a top-grooved-surface and a bottom-flat-surface and having a plurality of base-plate-slotted-holes, wherein each sectioned-base-plate is attached to a respective main-column of a plurality of main-columns;

c) a plurality of locking-plates having a bottom-locking-grooved-surface and a top-locking-flat-surface and having a plurality of locking-plate-holes, wherein each locking-plate-hole is aligned with a corresponding base-plate-slotted-hole; and d) a plurality of bolts and a plurality of bolt nuts connect the plurality of locking-plates, the plurality of sectioned-base-plates, and the middle-plate.

2. A modular connector, comprising:

a) a middle-plate having a plurality of middle-plate-slotted-holes, wherein the middle-plate includes a vertical-extension orthogonally positioned on an end thereof configured to connect with a wall;

b) a top-base-plate attached to a top of the middle-plate and a bottom-base-plate attached to a bottom of the middle-plate, wherein the top-base-plate and the bottom-base-plate are comprised of a plurality of sectioned-base-plates having a top-grooved-surface and a bottom-flat-surface and having a plurality of base-plate-slotted-holes, wherein each sectioned-base-plate is attached to a respective main-column of a plurality of main-columns;

c) a plurality of locking-plates having a bottom-locking-grooved-surface and a top-locking-flat-surface and having a plurality of locking-plate-holes, wherein each locking-plate-hole is aligned with a corresponding base-plate-slotted-hole; and d) a plurality of bolts and a plurality of bolt nuts connect the plurality of locking-plates, the plurality of sectioned-base-plates, and the middle-plate;

wherein the middle-plate has a plurality of vertical-base-plate-slotted-holes located on the vertical-extension, and a plurality of anchor-bolts and the plurality of bolt-nuts connect the plurality of locking-plates, the plurality of sectioned-base-plates, and the middle-plate.

3. The modular connector of claim 2, further comprising a plurality of short-columns, wherein each short-column is configured to fit inside each respective main-column, and wherein the plurality of short-columns are correspondingly attached to the plurality of the sectioned-base-plates.

4. The modular connector of claim 2, wherein each sectioned-base-plate is welded to each main-column.

5. The modular connector of claim 2, wherein the top-groove-surface and the bottom-locking-grooved-surface have triangular grooved structures.

6. The modular connector of claim 2, wherein the vertical-extension is attached to the middle-plate by welding.

7. The modular connector of claim 2, further comprising a fillet-section attached to the middle-plate and the vertical-extension.

8. The modular connector of claim 2, wherein the vertical-extension has a vertical-grooved-surface.

9. The modular connector of claim 8, wherein the vertical-grooved-surface has triangular grooved structures.

10. A modular connector, comprising:

a) a middle-plate having a plurality of middle-plate-slotted-holes, wherein the middle-plate includes a vertical-extension orthogonally positioned on an end thereof configured to connect with a wall;

b) a top-base-plate attached to a top of the middle-plate and a bottom-base-plate attached to a bottom of the middle-plate, wherein the top-base-plate and the bottom-base-plate are comprised of a plurality of sectioned-base-plates having a top-grooved-surface and a bottom-flat-surface and having a plurality of base-plate-slotted-holes, wherein each sectioned-base-plate is attached to a respective main-column of a plurality of main-columns;

c) a plurality of locking-plates having a bottom-locking-grooved-surface and a top-locking-flat-surface and having a plurality of locking-plate-holes, wherein each locking-plate-hole is aligned with a corresponding base-plate-slotted-hole;

d) a plurality of short-columns, wherein each short-column is configured to fit inside each respective main-column, and wherein the plurality of short-columns are correspondingly attached to the plurality of the sectioned-base-plates; and e) a plurality of bolts and a plurality of bolt nuts connect the plurality of locking-plates, the plurality of sectioned-base-plates, and the middle-plate;

wherein the middle-plate has a plurality of vertical-base-plate-slotted-holes located on the vertical-extension, and a plurality of anchor-bolts and the plurality of bolt-nuts connect the plurality of locking-plates, the plurality of sectioned-base-plates, and the middle-plate.

11. A method of assembling the modular connector of claim 1, comprising steps of:

a) placing a plurality of lower-modules in a planned location wherein each lower-module has a rectangular-box-shape and plurality of main-columns wherein a plurality of sectioned-base-plates having a top-grooved-surface, a bottom-flat-surface, and having a plurality of base-plate-slotted-holes are attached to each end of the plurality of main-columns;

b) attaching a middle-plate on the plurality of bottom-flat-surfaces wherein the middle-plate has a plurality of middle-plate-slotted-holes;

c) placing a plurality of upper-modules on the middle-plate wherein the base-plate-slotted-hole in the upper-module is configured to be parallel to the base-plate-slotted-hole in each upper-module, but orthogonal to base-plate-slotted-hole in each lower-module;

d) aligning the middle-plate and the plurality of upper-modules orthogonally so that a bolt is configured to go through each base-plate-slotted-hole and each middle-plate-slotted-hole;

e) positioning a plurality of locking-plates on a plurality of top-base-plate and under a plurality of bottom-base-plate wherein the top-base-plate and the bottom-base-plate are composed of the plurality of sectioned-base-plates and wherein each locking-plate has a locking-plate-hole and has a bottom-locking-grooved-surface facing the top-grooved-surface;

f) inserting the bolt into the plurality of locking-plate-holes, the plurality of base-plate-slotted-holes, and the middle-plate-slotted-hole, and g) tightening each bolt with a bolt-nut.

12. A method of assembling the modular connector of claim 2, comprising steps of:

a) placing a plurality of lower-modules in a planned location wherein each lower-module has a rectangular-box-shape and plurality of main-columns wherein a plurality of sectioned-base-plates having a top-grooved-surface, a bottom-flat-surface, and having a plurality of base-plate-slotted-holes are attached to each end of the plurality of main-columns;

b) attaching a middle-plate on the plurality of bottom-flat-surfaces wherein the middle-plate has a plurality of middle-plate-slotted-holes;

c) placing a plurality of upper-modules on the middle-plate wherein the base-plate-slotted-hole in the upper-module is configured to be parallel to the base-plate-slotted-hole in each upper-module, but orthogonal to base-plate-slotted-hole in each lower-module;

d) aligning the middle-plate and the plurality of upper-modules orthogonally so that a bolt is configured to go through each base-plate-slotted-hole and each middle-plate-slotted-hole;

e) positioning a plurality of locking-plates on a plurality of top-base-plate and under a plurality of bottom-base-plate wherein the top-base-plate and the bottom-base-plate are comprised of the plurality of sectioned-base-plates and wherein each locking-plate has a locking-plate-hole and has a bottom-locking-grooved-surface facing the top-grooved-surface;

f) inserting the bolt into the plurality of locking-plate-holes, the plurality of base-plate-slotted-holes, and the middle-plate-slotted-hole, and g) tightening each bolt with a bolt-nut.

13. The method according to claim 12, wherein the vertical-extension has a vertical-grooved-surface.

14. The method according to claim 12, further including aligning the middle-plate with respect to the plurality of vertical-base-plate-slotted-holes and the plurality of anchor bolts and tightening each anchor-bolt with the bolt-nut.

* * * * *